US012389984B2

(12) United States Patent
Lin et al.

(10) Patent No.: US 12,389,984 B2
(45) Date of Patent: Aug. 19, 2025

(54) SHOE

(71) Applicant: Amplifi Tech (Xiamen) Limited, Fujian (CN)

(72) Inventors: Yu-Chia Lin, Taipei (TW); Hsuan-Jen Yao, New Taipei (TW)

(73) Assignee: Amplifi Tech (Xiamen) Limited, Xiamen (CN)

( * ) Notice: Subject to any disclaimer, the term of this patent is extended or adjusted under 35 U.S.C. 154(b) by 0 days.

(21) Appl. No.: 18/610,614

(22) Filed: Mar. 20, 2024

(65) Prior Publication Data

US 2024/0373983 A1 Nov. 14, 2024

(51) Int. Cl.

| | |
|---|---|
| ***A43B 3/24*** | (2006.01) |
| ***A43B 13/02*** | (2022.01) |
| ***A43B 13/36*** | (2006.01) |

(52) U.S. Cl.

CPC ..... *A43B 13/36* (2013.01); *A43B 3/244* (2013.01); *A43B 13/02* (2013.01)

(58) Field of Classification Search

CPC ..... A43B 13/36; A43B 3/244
USPC ..... 36/100, 101, 15
See application file for complete search history.

(56) References Cited

U.S. PATENT DOCUMENTS

| | | | | |
|---|---|---|---|---|
| 2,119,392 | A * | 5/1938 | Levin | A43B 3/24 D2/977 |
| 2,409,813 | A * | 10/1946 | Timson | A43B 3/248 36/105 |
| 2,438,711 | A * | 3/1948 | Leach | A43B 3/244 36/12 |
| 2,551,723 | A * | 5/1951 | Camero | A43B 3/126 36/11.5 |
| 8,850,723 | B2 * | 10/2014 | Greene | A43B 19/00 36/105 |
| 10,092,063 | B2 | 10/2018 | Waatti | |
| 10,512,303 | B2 * | 12/2019 | Ramsay | A43B 23/0245 |
| 11,160,326 | B2 * | 11/2021 | Bramani | A43B 3/244 |
| 11,382,382 | B2 * | 7/2022 | Oden | A43B 23/027 |
| 2019/0116936 | A1 * | 4/2019 | Aceves Tinajero | A43B 9/00 |
| 2019/0261735 | A1 * | 8/2019 | Wawrousek | B29C 44/08 |

FOREIGN PATENT DOCUMENTS

| | | |
|---|---|---|
| CN | 202980331 U | 6/2013 |
| CN | 203314215 U | 12/2013 |
| CN | 106820427 A | 6/2017 |

* cited by examiner

*Primary Examiner* — Ted Kavanaugh
(74) *Attorney, Agent, or Firm* — Cooper Legal Group, LLC

(57) ABSTRACT

The present disclosure provides a shoe comprising: a bottom part; a plurality of first connecting parts; a covering part; a plurality of second connecting parts; and a flexible fastener, in which the covering part extends from a position adjacent to the upper edge of the bottom part toward an interior of the shoe to form an extension part, while the covering part can also extend upward from the position adjacent to the upper edge of the bottom part to form an upper portion, in which the extension part is at least partially located on an upper surface of the bottom part. The bonding of the shoe of the present disclosure has no need to use adhesives, while the bonding method of the shoe can accommodate both the stability of the bonding as well as the comfort of wearing.

8 Claims, 7 Drawing Sheets

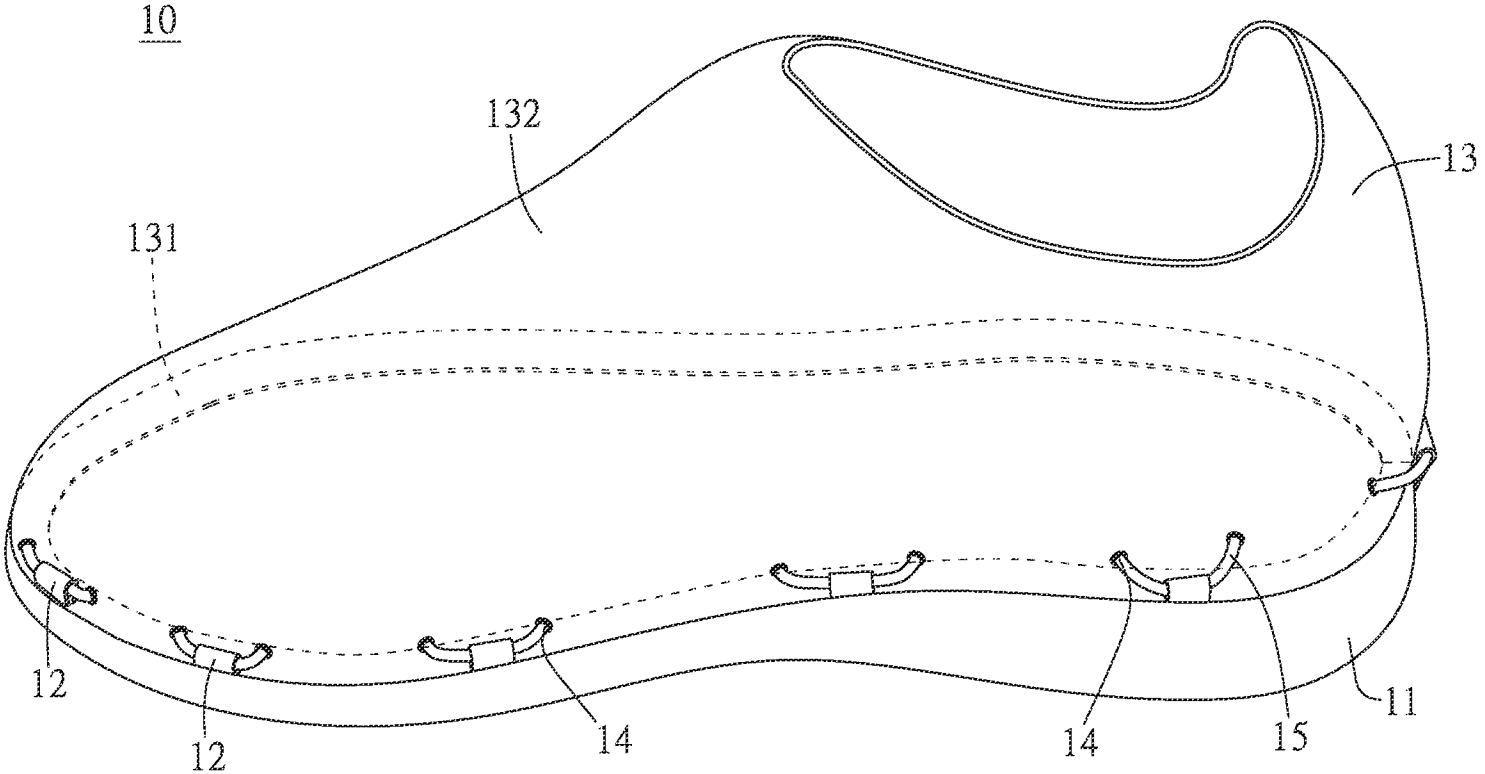
【Figure 1】

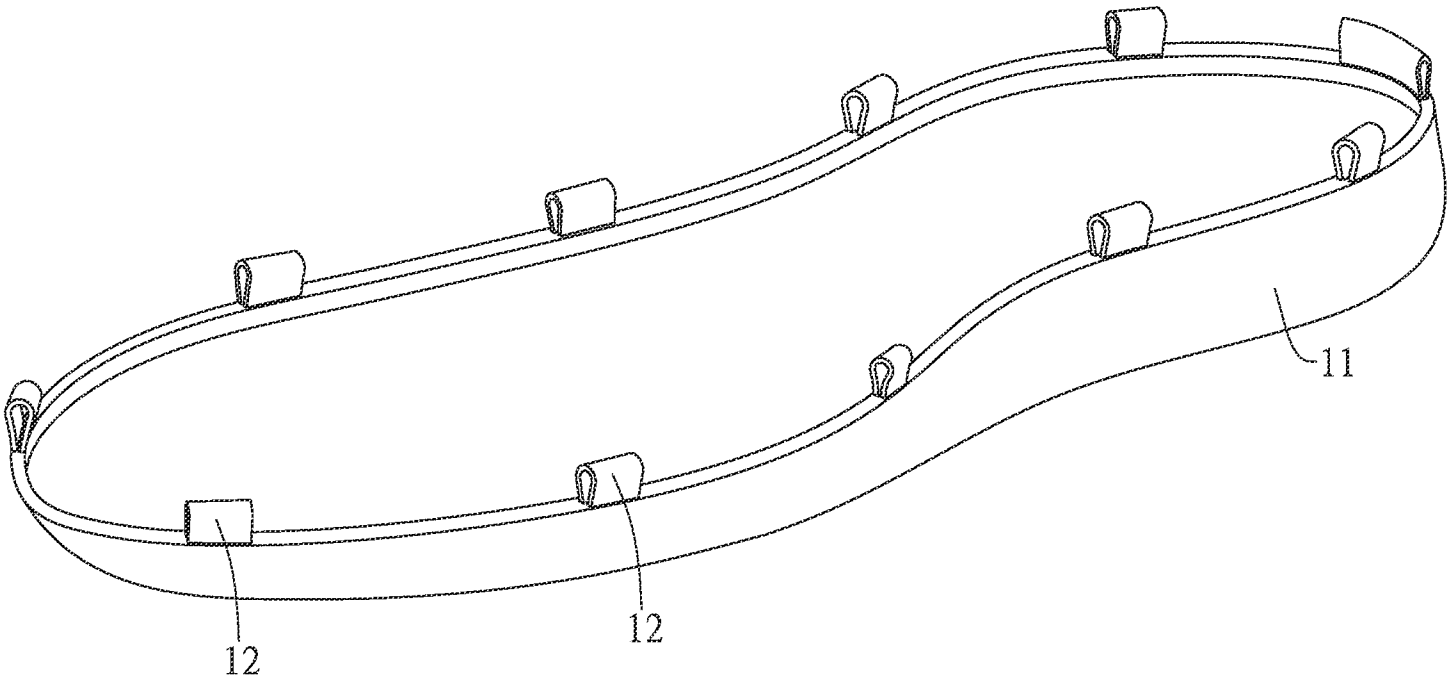
【Figure 2】

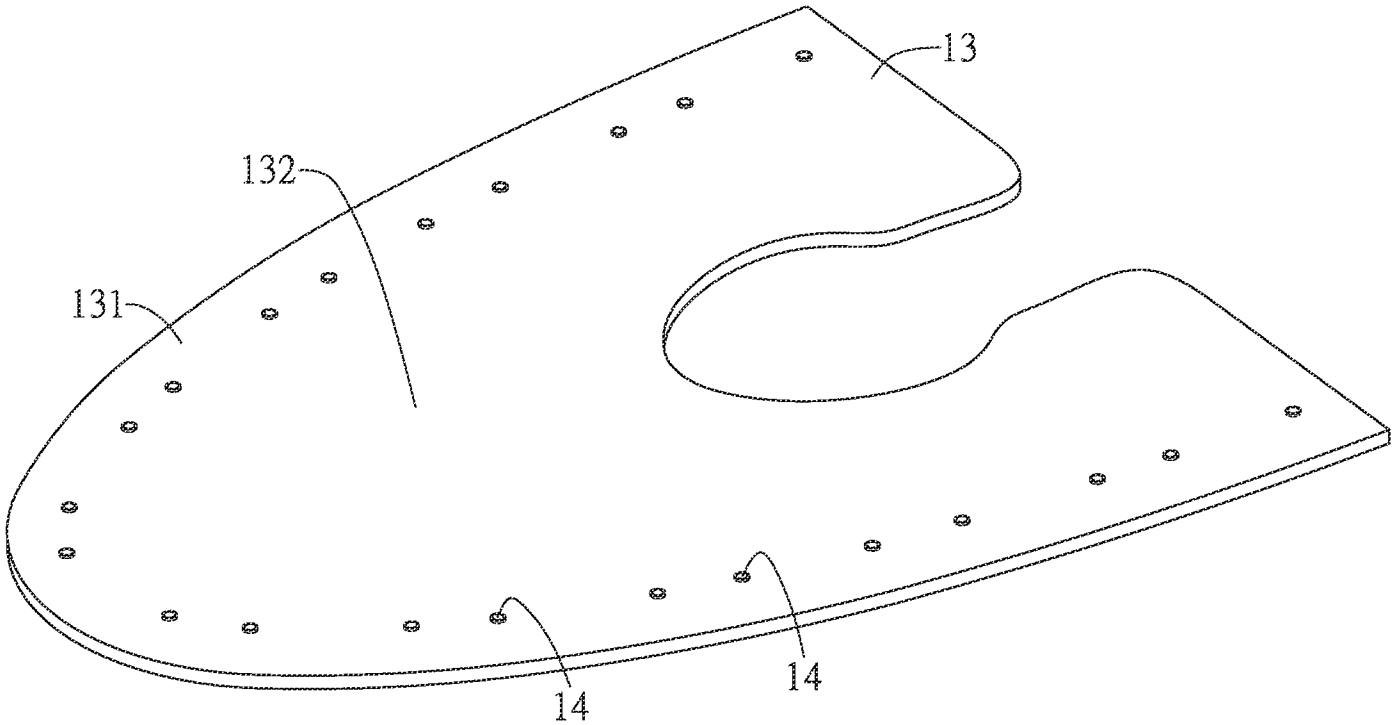
【Figure 3】

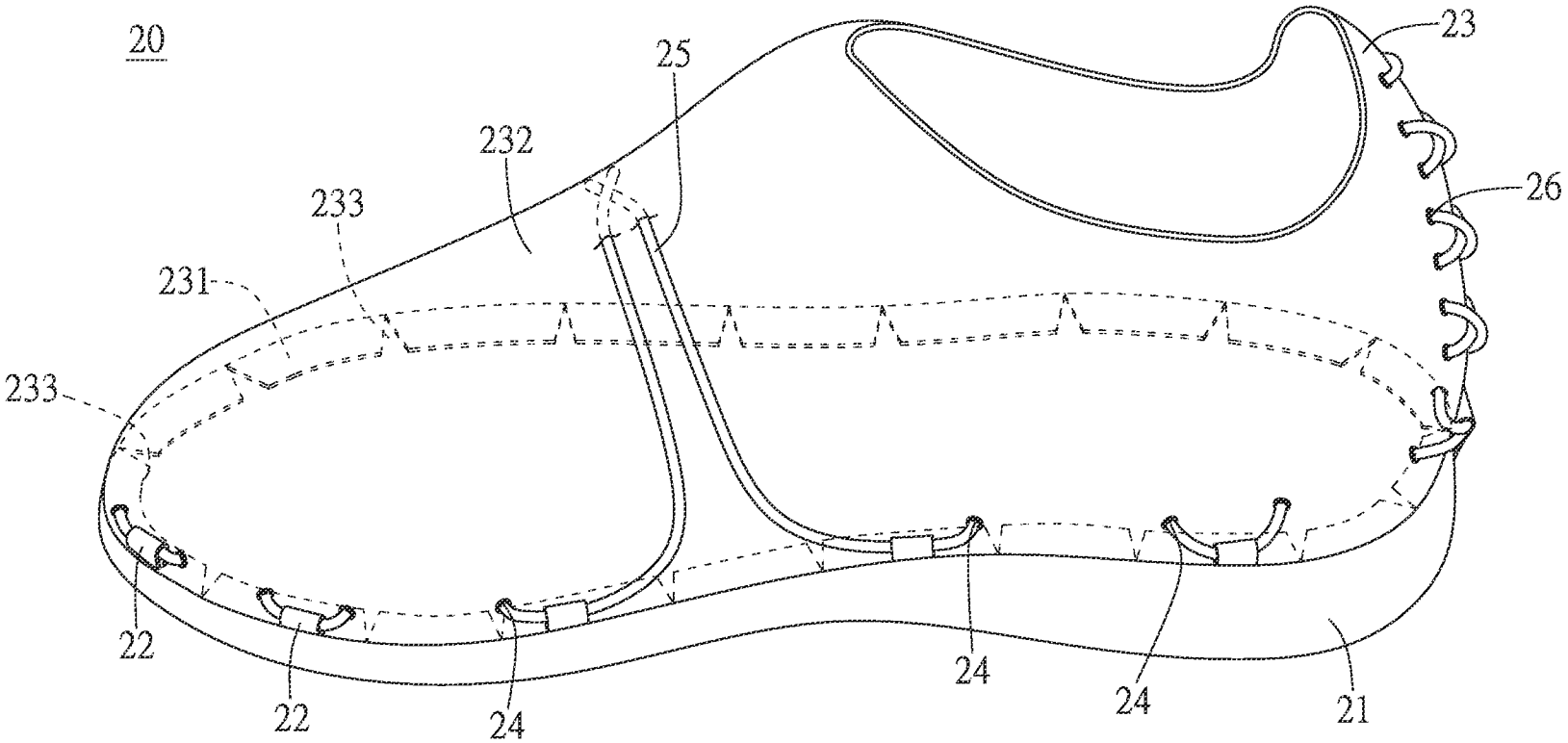
【Figure 4】

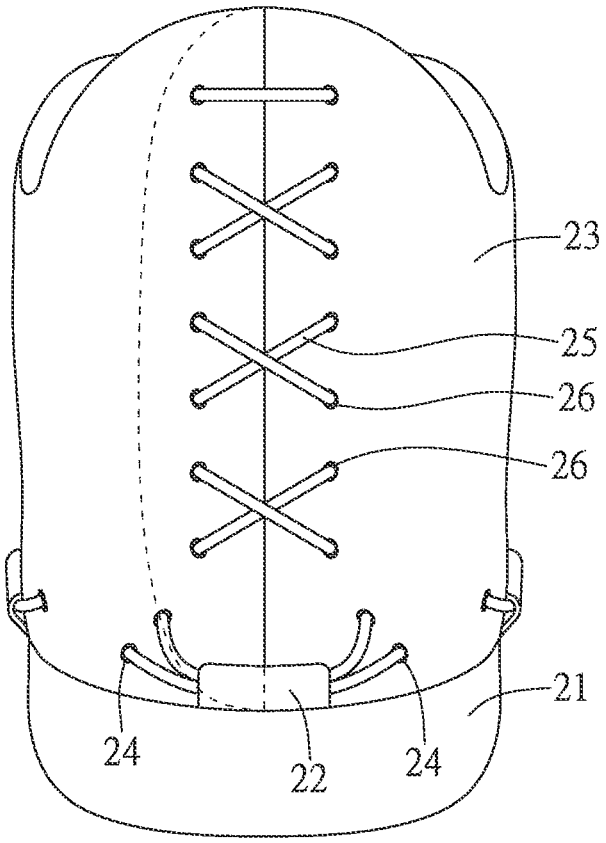
【Figure 5】

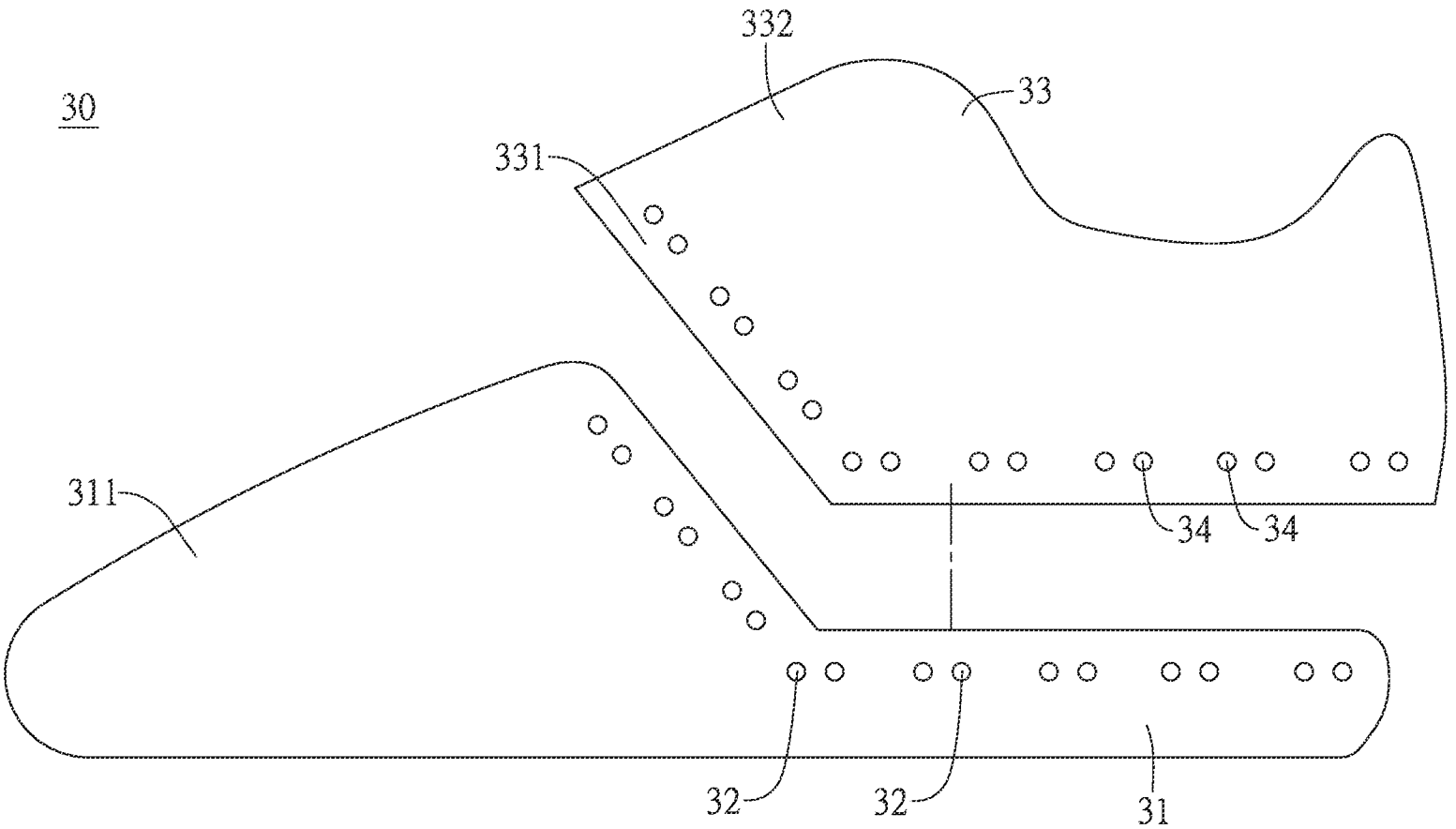
【Figure 6】

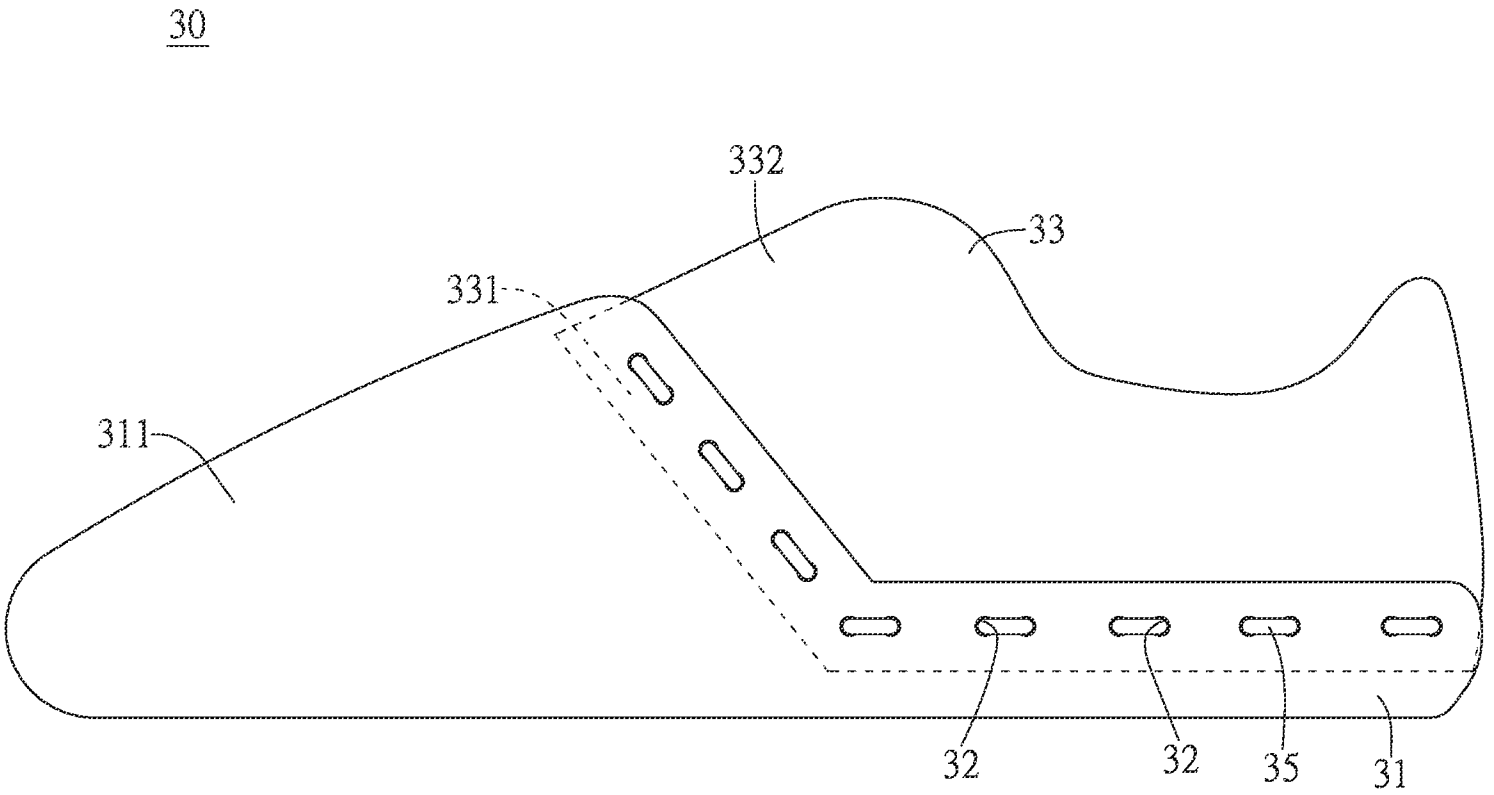
【Figure 7】

SHOE

CROSS-REFERENCE TO RELATED APPLICATION

This application claims priority to Chinese Patent Application 202310515609.1, filed May 9, 2023, which is incorporated herein by reference.

FIELD OF DISCLOSURE

The present disclosure relates to a shoe, more specifically, to a shoe without using adhesives for bonding.

DESCRIPTION OF RELATED ART

Traditionally, shoes are assembled by bonding multiple parts, primarily through using adhesives. However, in a production process using adhesives, vast amounts of volatile organic gas is generated, which may affect the health of operating personnel and is not environmentally friendly. That is why there is a need for finding a green bonding method for shoes.

U.S. Pat. No. 10,092,063 discloses a method that bonds an upper portion to a sole structure of footwear by using mechanical connectors. Although mechanical connectors can provide fastening connections, mechanical connectors lack flexibility. Therefore, the mechanical connectors can be disengaged as the bonding area of the upper portion and the sole structure is impacted or deformed while users are moving.

A utility model patent, China Patent No. CN203314215U, discloses a shoe having connecting holes on the edge of the upper portion and the bottom of the shoe in a one-to-one pairing configuration, which allows a strip to pass through the connecting holes, located on the upper portion and the bottom separately and connects the upper portion and the bottom. However, the junction between the upper portion and the bottom, which is covered by strips, may be opened in the gap between the strips and may expose a consumer's foot and lead to inadequacy of coverage. Furthermore, connecting holes are located on the edges of the upper portion and the bottom respectively. After a long period of use, the peripheral area of the connecting holes can be worn out and cracked to open, and the peripheral area can be broken off from the edges of the upper portion and the bottom. Therefore the function of bonding can no longer remain.

SUMMARY

In view of the aforementioned problems of the shoe of the prior art, the present disclosure provides a shoe, more specifically, a shoe without using adhesives.

In order to achieve the aforementioned purposes and other objectives, the present disclosure provides a shoe, which comprises:

- a bottom part, which is at least comprised of a sole of a shoe;
- a plurality of first connecting parts, which are disposed on an upper peripheral edge of the bottom part;
- a covering part, which is a sheet made of flexible material, wherein the covering part extends from a position adjacent to the upper peripheral edge of the bottom part toward an interior of the shoe to form an extension part, and the covering part also extends upward from the position adjacent to the upper peripheral edge of the bottom part to form an upper portion, wherein the extension part at least partially disposed on an upper surface of the bottom part;
- a plurality of second connecting parts, which are disposed on the covering part and at the position adjacent to the upper peripheral edge of the bottom part; and
- a flexible fastener, which is connected with the first connecting parts and the second connecting parts, the flexible fastener fastening the covering part on the bottom part.

As for the aforementioned shoe, the first connecting parts can be a plurality of loops or holes.

As for the aforementioned shoe, the second connecting parts of the shoe can be a plurality of eyelets.

As for the aforementioned shoe, the extension part of the shoe can have a plurality of cuts.

As for the aforementioned shoe, the extension part of the shoe can extend from the position adjacent to the upper peripheral edge of the bottom part toward the interior of the shoe for a distance of 5 mm-25 mm.

As for the aforementioned shoe, the first connecting parts and the bottom part of the shoe can be seamlessly integrated.

As for the aforementioned shoe, the bottom part of the shoe can be an elastomer made by three-dimensional (3D) printing, injection molding, casting, foaming or stamping;

As for the aforementioned shoe, the bottom part of the shoe comprises a sole and a toe box (the front covering part of the shoe).

As for the aforementioned shoe, the covering part of the shoe is a textile material or of a material made by a 3D printing process.

As for the aforementioned shoe, the flexible fastener of the shoe can be a type of string.

As for the aforementioned shoe, the flexible fastener of the shoe can be laced up across the upper portion.

The bonding of the shoe of the present disclosure has no need to use adhesives, avoids generating vast amount of volatile organic gas, and addresses both environmental and health of operating personnel. In addition, the shoe bonding method of the present disclosure accommodates both stability of the bonding and the comfort of wearing.

BRIEF DESCRIPTION OF THE DRAWINGS

To better understand the novel features, contents, and advantages of the present disclosure, the detailed descriptions of the present disclosure are provided as follows, along with figures and preferred embodiments. The thickness and dimensions displayed on the figures and exemplary embodiments can be enlarged, simplified, or generalized in descriptions, without necessarily implying the actual size, ratio, and precise configurations of each element.

FIG. 1 is a schematic view of the shoe of Embodiment 1 of the present disclosure;

FIG. 2 is a schematic view of the bottom part of the shoe of Embodiment 1 of the present disclosure;

FIG. 3 is a schematic view of the covering part of the shoe of Embodiment 1 of the present disclosure;

FIG. 4 is a schematic view of the shoe of Embodiment 2 of the present disclosure;

FIG. 5 is a schematic view of the heel counter of the shoe of Embodiment 2 of the present disclosure;

FIG. 6 is an exploded-view schematic drawing of the shoe of Embodiment 3 of the present disclosure; and FIG. 7 is a schematic view of the shoe of Embodiment 3 of the present disclosure.

DETAILED DESCRIPTION

Embodiment 1

Please refer to FIG. 1 to FIG. 3, in which, FIG. 1 is a schematic view of the shoe of Embodiment 1 of the present disclosure, FIG. 2 is a schematic view of the bottom part of the shoe of Embodiment 1 of the present disclosure, and FIG. 3 is a schematic view of the covering part of the shoe of Embodiment 1 used in the present disclosure. As shown in FIG. 1 to FIG. 3, the shoe 10 of Embodiment 1 comprises: a bottom part 11; a plurality of first connecting parts 12; a covering part 13; a plurality of second connecting parts 14; and a flexible fastener 15.

In the embodiment, the bottom part 11 constitutes, but not limited to, the sole of the shoe 10. In another embodiment, the bottom part 11 can further constitute parts other than the sole of the shoe 10 of the present disclosure. For example, in Embodiment 3 described below, the bottom part 11 can further constitute the sole and the toe box of the shoe 10.

In the embodiment, the plurality of first connecting parts 12 are disposed on the upper edge of the bottom part 11. In the shoe of Embodiment 1, the first connecting parts 12 are, but not limited to, a plurality of loops. In another embodiment, the plurality of first connecting parts 12 may be eyelets or structures that provide connecting functions.

In the embodiment, the covering part 13 is comprises a sheet made of flexible material. The covering part 13 extends from a position adjacent to the upper peripheral edge of the bottom part 11 toward the interior of the shoe 10 to form an extension part 131, while the covering part 13 can also extend upward from a position adjacent to the upper peripheral edge of the bottom part 11 to form an upper portion 132, in which the extension part 131 is disposed on the upper surface of the bottom part 11.

In the embodiment, the extension part 131 is disposed, but not limited to, on the upper surface of the bottom part 11. In another embodiment, the extension part 131 is partially disposed on the upper surface of the bottom part 11.

In the embodiment, the shoe 10 has a design without shoelaces. The covering part 13 that covers the bridge of the user does not consist of a tongue, a gap between facings, and holes for shoelaces to pass through. However, the present disclosure does not limited to these embodiments. In another embodiment, the covering part 13 comprises a tongue, a gap between facings, and the holes for shoelaces to pass through recited in the prior art to allow the user to put on and taken off the shoes with the use of shoelaces. Furthermore, in other embodiments, the covering part 13 has other devices recited in the prior art to allow the user to put on and taken off the shoes.

In the embodiment, a plurality of second connecting parts 14 are disposed on the covering part 13 and at a position adjacent to the upper peripheral edge of the bottom part 11.

In the embodiment, the second connecting parts 14 are, but not limited to, holes. In another embodiment, the second connecting parts 14 have a structure for the use of connecting parts.

In the embodiment, the flexible fastener 15 is connected with the first connecting parts 12 and the second connecting parts 14, so that the covering part 13 is firmly mounted on the bottom part 11.

In the embodiment, the flexible fastener 15 is, but not limited to, a string or cord. In another embodiment, the flexible fastener 15 is a strip part or a structure that provides connecting functions.

In the embodiment, the flexible fastener 15 connects the first connecting parts 12 and the second connecting parts 14 and fastens the covering part 13 on the bottom part 11. Therefore, the bonding of the shoe 10 has no need to use adhesives and avoids generating vast amount of volatile organic gas, which addresses both environmental concerns and the health of operating personnel.

In the embodiment, the covering part 13 extends from a position adjacent to the upper peripheral edge of the bottom part 11 toward the interior of the shoe 10 to form the extension part 131, which improves the stability of the bonding between the covering part 13 and the bottom part 11. Additionally, the extension part 131 provides further coverage for the users' feet and elevates comfort of wearing.

Embodiment 2

Please refer to FIG. 4 and FIG. 5. FIG. 4 is a schematic view of the shoe of Embodiment 2 of the present disclosure, and FIG. 5 is a schematic view of the heel counter of the shoe of Embodiment 2 of the present disclosure.

The shoe 20 of this embodiment is similar to that of Embodiment 1 in that the shoe 20 comprises: a bottom part 21; a plurality of first connecting parts 22; a covering part 23; a plurality of second connecting parts 24; and a flexible fastener 25, in which the covering part 23 extends from a position adjacent to the upper peripheral edge of the bottom part 21 toward the interior of the shoe 20 to form an extension part 231, while the covering part 23 can also extend upward from a position adjacent to the upper edge of the bottom part 21 to form an upper portion 232, in which the extension part 231 is disposed on the upper peripheral surface of the bottom part 21.

The corresponding features of Embodiment 2 and Embodiment 1 will not be repeated here again.

In comparison to Embodiment 1, the extension part 231 of Embodiment 2 has a plurality of cuts 233, making the extension part 231 more closely appressed to the upper surface of the bottom part 21 and preventing wrinkles.

In comparison to Embodiment 1, the flexible fastener 25 of Embodiment 2 traverses across the upper portion 232, and the flexible fastener 25 is laced-up in a crisscrossed pattern over the upper portion 232. Therefore, the flexible fastener 25 of Embodiment 2 connects the first connecting parts 22 and the second connecting parts 24 and tightens the upper portion 232 to fit the bridge of the user, also, providing a desired visual effect.

As marked with a dotted line in FIG. 5, the covering part 23 of the embodiment is overlapped in the heel counter of the shoe 20. As shown in FIG. 4 and FIG. 5, a plurality of third connecting parts 26 are disposed on the covering part 23 at the heel of the shoe 20, and the third connecting parts 26 are disposed along the junction of both ends of the covering part 23. As shown in FIG. 4 and FIG. 5, the flexible fastener 25, passing in and out repeatedly through the third connecting parts 26 located at the heel counter of the shoe 20, connects the edges at both ends of the covering part 23 at the heel of the shoe 20 through a physical manner. In the embodiment, the third connecting parts 26 are, but not limited to, a plurality of holes. The connecting method described in the embodiment has no need to use adhesives at the heel counter of the shoe 20, achieving glueless assembly. Furthermore, the connecting method described in the embodiment also has no need to do needlework or sewing at the heel of the shoe 20 to connect the covering part 23, and therefore the preparation process of the shoe 20 can be simplified. Moreover, the connecting method in this embodiment can be performed by consumers themselves, so that consumers are able to assemble or disassemble the shoe 20 at any time as they need. For example, consumers may disassemble the shoe 20 by themselves for traveling or packing purposes. Additionally, consumers can optionally purchase the covering parts 23, the bottom parts 21, and the flexible fasteners 25 in different colors or patterns and decide how to match the covering parts 23, the bottom parts 21, and the flexible fasteners 25 to match their wearing styles.

In another embodiment, both ends of the flexible fastener 25 can pass through a snap fastener respectively, in which the snap fastener can movably fasten the flexible fastener 25. When the snap fastener is pressed, the flexible fastener 25 can be released, allowing the position of the flexible fastener 25 be adjusted, which can adjust the tightness of the covering part 23 wrapped around the consumer's heel. When the snap fastener is not pressed, the flexible fastener 25 is fixed, allowing the covering part 23 to wrap the consumer's heel with stable tightness. Furthermore, the snap fastener can be used for collecting the flexible fastener 25, thereby preventing the consumer from tripping due to a loose flexible fastener 25 while walking.

Embodiment 3

Please refer to FIG. 6 and FIG. 7, in which FIG. 6 is an exploded-view schematic drawing of the shoe of Embodiment 3 of the present disclosure; and FIG. 7 is a schematic view of the shoe of Embodiment 3 of the present disclosure.

The shoe 30 of this embodiment is similar to that of Embodiment 1 in which the shoe 30 comprises: a bottom part 31; a plurality of first connecting parts 32; a covering part 33; a plurality of second connecting parts 34; and a flexible fastener 35, in which the covering part 33 extends from a position adjacent to the upper peripheral edge of the bottom part 31 toward the interior of the shoe 30 to form an extension part 331, and the covering part 33 also extends upward from a position adjacent to the upper edge of the bottom part 31 to form an upper portion 332, in which the extension part 331 is disposed on the upper peripheral surface of the bottom part 31.

The corresponding features of Embodiment 3 and Embodiment 1 will not be repeated here again.

In comparison to Embodiment 1, the bottom part 31 of Embodiment 3 not only constitutes a sole of the shoe 30, but also constitutes a toe box part 311 of the shoe 30, which provides additional covering and protection to the toe area of a consumer, and elevates the stability of the connection of the shoe 30. Due to the deployment of the toe box part 311, the extension part 331 of the embodiment is only partially disposed on the upper surface of the bottom part 31, and the rest of the extension part is disposed on the interior surface of the toe box part 311.

In comparison to Embodiment 1, the bottom part 31 of Embodiment 3 can be solely worn as slippers or can be connected with the covering part 33 through the flexible fasteners 35.

In comparison to Embodiment 1, the first connecting parts 32 and the second connecting parts 34 of Embodiment 3 both are a plurality of holes, which can be connected through the flexible fasteners 35 to fasten the covering part 33 on the bottom part 31.

In the shoe of the present disclosure, the materials and methods of composition of each part are not limited to specific selections. The technological concepts and characteristics of the present disclosure can be adjusted by those skilled in the art to which the present disclosure described in the patent specification and the appended claims pertains, without departing from its spirit and scope. For further illustration, the present disclosure will become more fully understood from (but not limited to) the detailed descriptions and embodiments given below.

The bottom part of the shoe of the present disclosure can be an elastomer made by three-dimensional (3D) printing, injection molding, casting, foaming, or embossing, in which the structure of the bottom part can have various densities to provide various properties. For example, the density of the central area of the sole is lower, which provides better comfort of wearing, whereas the density of the surrounding area of the sole is higher, which provides a stronger mechanical strength. In addition, each part of the sole structure can be comprised of different materials.

In the shoe of the present disclosure, the first connecting parts and the bottom part can be seamless integrated through 3D printing, with a certain mechanical strength. The first connecting part has a height of H, wherein H is 1 to 2 times of a diameter of the flexible fastener. The first connecting parts can be made by injection molding, casting, foaming, or stamping.

In the shoe of the present disclosure, the covering part can be a textile material, a material made by a 3D printing process, polymer yarns, genuine leather, suede, faux leather, or thermoplastic polyurethane (TPU). The extension part of the covering part extends from a position adjacent to the upper peripheral edge of the bottom part toward the interior of the shoe for a range of 3 mm-25 mm, or preferably 3-20 mm, or more preferably 5-15 mm. When the covering part is a textile material, finish work may be done at the edge of the covering part to prevent fraying. The edge finish methods are, but not limited to, folding hem edge finishing, bias binding edge finishing, and laser cutting edge finishing, etc.

In the shoe of the present disclosure, the flexible fastener can be a type of string, textile products, rope, polymer yarn, stranded rope, and braided rope. The flexible fastener provides a function of connecting the bottom part with the covering part and provides the desired appearance. For example, the flexible fastener can be a ribbon or a thick rope to create a contrasting visual effect. The end of the flexible fastener can be tied with a knot or fixed with a snap fastener. Moreover, the extensibility of the flexible fastener can be 0-100%, preferably 0-50%, or more preferably 1-20%. The length of the flexible fastener is not limited to any specific standards. The length thereof can be 80 cm-540 cm, preferably 12 cm-480 cm, or more preferably 160 cm-300 cm. The length thereof is associated with the shoe size and how many times the flexible fastener is to wrap around the bridge of a foot. The diameter of the flexible fastener can be 2 mm-25 mm, preferably 3 mm-15 mm, or more preferably 4-10 mm. In addition, the flexible fastener has a particular tensile strength of at least 5 kg-40 kg, preferably greater than 10 kg-35 kg, or more preferably greater than 20 kg-30 kg. There is no upper limit of the tensile strength, and the required tensile strength thereof is associated with the actual numbers of the first connecting parts and the second connecting parts.

In the shoe of the present disclosure, the first connecting parts and the second connecting parts do not need to have a one-to-one pairing configuration. Those skilled in the art can select the connecting methods based on the desired levels of tightness, properties of the upper portion, and aesthetic effects. Besides, the distances between the adjacent first connecting parts can be different.

In the shoe of the present disclosure, the first connecting parts are disposed on the upper peripheral edge of the bottom part and formed to have a height H' in the direction perpendicular to the ground, which allows the extension part be folded toward the central part of the sole and be gathered and remain within the space surrounded by the first connecting parts. Therefore, the stability of the connection between the bottom part and the covering part can be further improved. The height H' and the thickness of the sole match with each other. The bottom part can also have a depth "h", which is below the lower edge of the first connecting parts, wherein H'+h=(thickness of the sole)+(thickness of the extension part being gathered).

The shoe of the present disclosure can provide a modular design. Consumers can optionally purchase the covering parts with different colors, patterns, air permeability, supporting capability; bottom parts with different anti-slip capability, shock absorbing capability, thrust; and flexible fasteners with different extensibility, stretching capability, colors, and styles. The customers can assemble those parts as they need. Consumers may optionally buy or replace the covering parts, bottom parts, and flexible fasteners, according to their preferred asthenic or functional need. When any parts (covering parts, bottom parts, or flexible fasteners) are worn out or damaged, they can individually be replaced, there is no need to discard the entire shoe.

The covering part of the shoe of the present disclosure can be jointed end-to-end through the flexible fasteners at the heel area after the covering part is produced in a two-dimensional format. Consumers can use the flexible fasteners to assemble the covering part in the two-dimensional format into a three-dimensional upper structure, which can accommodate a foot by themselves. Prior to the assembly, the covering part is packaged in a flat format, which is easy to pack, deliver, and store, and therefore reduces transportation cost and provides convenience to consumers to travel or store.

The shoe of the present disclosure can also be used by inserting an insole. By doing so, the insole and the sole sandwich the extension part that further provides the stability for wearing. The materials of such an insole can be ethylene/ethylene vinyl acetate (EVA), silicone, foam, or polyurethane (PU), which can be used along with fabric (such fabric can be textile or leather materials).

REFERENCE SIGNS

10 shoe
11 bottom part
12 first connecting part
13 covering part
131 extension part
132 upper portion
14 second connecting part
15 flexible fastener
20 shoe
21 bottom part
22 first connecting part
23 covering part
231 extension part
232 upper portion
233 cut
24 second connecting part
25 flexible fastener
26 third connecting part
30 shoe
31 bottom part
311 the part covering the upper edge
32 first connecting part
33 covering part
331 extension part
332 upper portion
34 second connecting part
35 flexible fastener

What is claimed is:

1. A shoe, comprising:

a bottom part, which is at least comprised of a sole of the shoe;

a plurality of first connecting parts, which are seamlessly and integrally formed with the bottom part via three-dimensional (3D) printing, and are disposed on an upper peripheral edge of the bottom part, wherein each of the plurality of first connecting parts has a first height;

a covering part, which is a sheet made of flexible material, wherein the covering part extends from a position adjacent to the upper peripheral edge of the bottom part toward an interior of the shoe to form an extension part, and the covering part also extends upward from the position adjacent to the upper peripheral edge of the bottom part to form an upper portion, wherein the extension part at least partially is disposed on an upper surface of the bottom part, and the extension part extends from the position adjacent to the upper peripheral edge of the bottom part toward the interior of the shoe for a distance of 5 mm-25 mm;

a plurality of second connecting parts, which are disposed on the covering part and at the position adjacent to the upper peripheral edge of the bottom part;

a plurality of third connecting parts, which are disposed on the covering part at a heel of the shoe, and are arranged along a junction where both ends of the covering part meet;

a flexible fastener, which is a single continuous string, connected with the first connecting parts and the second connecting parts, wherein the flexible fastener connects edges at both the ends of the covering part at the heel of the shoe in a physical manner by repeatedly passing in and out through the third connecting parts at the heel of the shoe, the flexible fastener fastens the covering part on the bottom part, and first height is 1 to 2 times a diameter of the flexible fastener; and an insole, which is placed on the bottom part and located within an area surrounded by the covering part, wherein the insole and the sole together sandwich the extension part.

2. The shoe as claimed in claim 1, wherein the first connecting parts are a plurality of loops or holes.

3. The shoe as claimed in claim 1, wherein the second connecting parts are a plurality of eyelets.

4. The shoe as claimed in claim 1, wherein the extension part has a plurality of cuts.

5. The shoe as claimed in claim 1, wherein the bottom part is an elastomer.

6. The shoe as claimed in claim 1, wherein the bottom part comprises the sole and a toe box part of the shoe.

7. The shoe as claimed in claim 1, wherein the covering part is a textile material or a material made by a 3D printing process.

8. The shoe as claimed in claim 1, wherein the flexible fastener is laced up across the upper portion.

* * * * *